US006237584B1

(12) United States Patent
Sims

(10) Patent No.: US 6,237,584 B1
(45) Date of Patent: May 29, 2001

(54) BOW STRING SILENCERS FOR ARCHERY BOWS

(76) Inventor: Steven C. Sims, 450 Enterprise Rd., Shelton, WA (US) 98054

( * ) Notice: Subject to any disclaimer, the term of this patent is extended or adjusted under 35 U.S.C. 154(b) by 0 days.

(21) Appl. No.: 09/466,512

(22) Filed: Dec. 17, 1999

(51) Int. Cl.[7] ..... F41B 5/20
(52) U.S. Cl. ..... 124/92
(58) Field of Search ..... 124/90, 92

(56) References Cited

U.S. PATENT DOCUMENTS

| | | | | |
|---|---|---|---|---|
| 3,059,629 | | 10/1962 | Stinson . | |
| 3,612,029 | | 10/1971 | Carroll . | |
| 3,756,214 | | 9/1973 | Christen . | |
| 3,837,327 | | 9/1974 | Saunders et al. . | |
| 4,023,551 | * | 5/1977 | Huddleston | 124/92 |
| 4,080,951 | | 3/1978 | Bateman, III . | |
| 5,016,604 | * | 5/1991 | Tilby | 124/92 |
| 5,362,046 | | 11/1994 | Sims . | |

OTHER PUBLICATIONS

String Silencer, shown on p. 31 of Archery magazine, Jan. 1978.*

Silencer shown on p. 31 of Bow & Arrow magazine, Jun. 1981.*

* cited by examiner

*Primary Examiner*—John A. Ricci
(74) *Attorney, Agent, or Firm*—Richard D. Multer

(57) ABSTRACT

String silencers for reducing the sound made when an arrow is released from a bow. These silencers are made from a material which allows the silencer to freely flex when the arrow is released and the bow string begins to vibrate. Silencers usable with conventional bow strings and with split bow strings are disclosed. Disclosed silencers for conventional bow strings have uniform and necked down configurations, and a representative, disclosed silencer for split bow strings has a center segment and integral arms at opposite ends of the center segment. With the silencer at rest, these arms extend in opposite directions from, and at equal angles to, the center segment.

12 Claims, 5 Drawing Sheets

BOW STRING SILENCERS FOR ARCHERY BOWS

TECHNICAL FIELD OF THE INVENTION

The present invention relates to archery bows and more, particularly, to novel, improved devices for minimizing the sound generated by a bow string when an arrow is released.

BACKGROUND OF THE INVENTION

A bow string makes a relatively loud sound when an arrow is released. This is disadvantageous as the sound may be loud enough to frighten away game a hunter is seeking or cause the bowman to flinch and the arrow to consequently go astray.

A variety of silencers for bow strings are available from Martin Archery, Cabala's Archery, and other sources. Available string savers are of several different types. One, due to its shape, is known as a "puff silencer." Puff silencers are typically made of leather and yarn strands.

A second type of silencer is the "whisker silencer," also named for its appearance. The whiskers of the silencer are commonly made from a rubber or comparably flexible material.

Other commercially available string silencers are made from fleece and such exotic materials as beaver hide.

The available devices, however, are not as effective as one might wish. Therefore, there is a continuing need for a better string saver.

SUMMARY OF THE INVENTION

There have now been invented and disclosed herein certain new and novel string silencers which are highly effective. Another advantage of the string silencers disclosed herein is that the reduction in initial arrow velocity, inevitably associated with the use of a string silencer, is very small.

One type of string silencer embodying the principles of the present invention and having the just-discussed advantages is a strip-like device fabricated from vibration damping material. These string silencers are knotted onto the bow string, one at each end of the string.

A second type of string silencer also embodying the principles of the present invention, is likewise fabricated from a vibration damping material. This string silencer is installed between the two parts of a split bow string and retained in place by complementary, integrated, silencer bosses. Split bow strings are commercially available, and other bow strings can be split to accommodate the silencers with a conventional string splitter.

The objects, novel features, and advantages of the present invention will be apparent to the reader from the foregoing and the appended claims and as the ensuing detailed description and discussion proceeds in conjunction with the accompanying drawing.

DETAILED DESCRIPTION OF THE INVENTION

Figure 1:
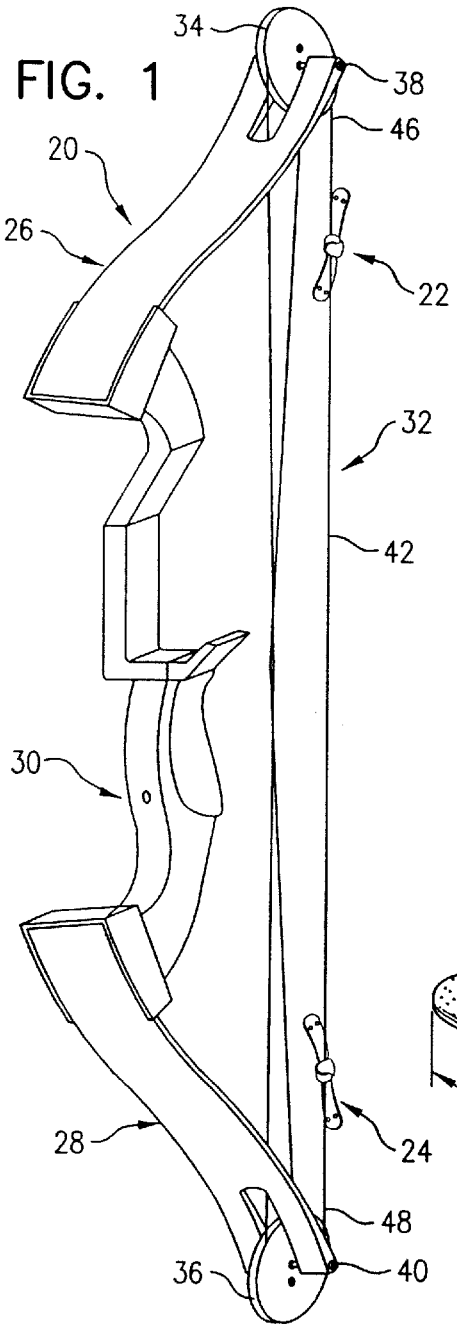
FIG. 1 is a perspective view of a compound bow equipped with string silencers embodying the principles of the present invention.

Referring now to the drawings, FIG. 1 depicts a compound bow 20 equipped with string silencers 22 and 24 in accord with the principles of the present invention. Bow 20 has flexible limbs 26 and 28 mounted to the opposite ends of a riser 30 and a bow string 32. The bow string is strung around cams 34 and 36 at the ends of limbs 26 and 28 with the ends of the bow string being anchored to the shafts 38 and 40 which support cams 34 and 36 from the limbs 26 and 28 of bow 20.

The two bow string silencers 22 and 24 are duplicates; accordingly, only bow string silencer 22, shown in more detail in FIGS. 2–4, will be described in detail herein.

Bow string silencer 22 is an elongated strip of an elastomeric material. Silencer 22 has a generally rectangular cross-section. This cross-section is uniform over the length of the silencer.

One material from which string silencer 22 can be made is NAVCOM. NAVCOM is a soft, amphorous, rubber-like material which contains a mixture of chloroprene and butyl polymers and the following physical properties (representative).

| Shore A hardness: 17–90 | | | | | |
|---|---|---|---|---|---|
| Environment | Shore A | Ultimate Elongation (Percent) | Tensile Strength (PSI) | Compression Set (Percent) | Specific Gravity |
| | 7 | 1,075 | 373 | 6.01 | 1.014 |
| | 12 | 900 | 643 | 7.3 | 1.025 |
| | 20 | 835 | 1,069 | 6.9 | 1.063 |

-continued

| | | | | | |
|---|---|---|---|---|---|
| | 30 | 1,056 | 1,621 | 4.0 | 1.074 |
| | 40 | 326 | 1,453 | N/A | 1.185 |
| | 90 | 175 | 2,440 | N/A | 1.379 |
| Oven aged | 7 | N/A | N/A | 56.3 | — |
| For | 12 | — | — | 31.1 | — |
| 70 hrs at | 20 | — | — | 30.8 | — |
| 212 = 5° F. | 40 | — | — | 22.4 | — |
| | 90 | — | — | 18.6 | — |

| | |
|---|---|
| Resilience: | At room temperature - Medium<br>At high temperature - Fairly high |
| Heat resistance | Good |
| Outdoor aging resistance: | Excellent |
| Low temp flexibility: | Good |
| Abrasion resistance: | Good |
| Flex life: | Good |
| Solvent resistance: | |
| Hydrocarbons - | Fair to good |
| Oxygenated - | Fair to good |
| Air permeability: | Low to moderate |
| Moisture resistance: | Fair |
| Useful operating temperature: | −40° to 250° F. |

Figure 4:
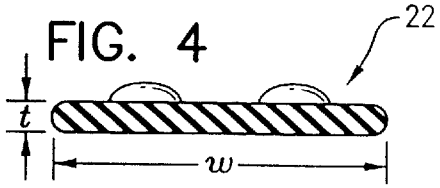
FIG. 4 is a section through the silencer, taken along line 4—4 of FIG. 3.
Figure 3:
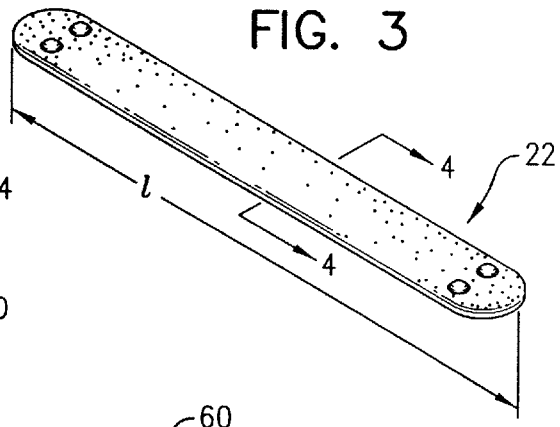
FIG. 3 is a perspective view of the silencer.

The approximate dimensions of a representative string silencer as shown in FIGS. 3 and 4 are:

| | |
|---|---|
| Length (l) | 3.25 in |
| Width (w) | 0.38 in |
| Thickness (t) | 0.1 in |

Figure 2:
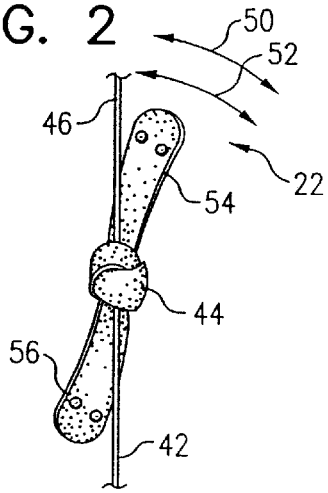
FIG. 2 is a fragment of FIG. 1 drawn to an enlarged scale to better show how a FIG. 1 silencer is attached to the string of the FIG. 1 bow.

As shown in FIGS. 1 and 2, string silencer 22 is attached to that run 42 of bow string 32 in which arrows are nocked as by knotting the silencer around the bow string with the illustrated overhand knot 44.

Bow string silencer 22 is thus attached to bow string 32 at one end 46 of run 42. The second bow string silencer 24 is in the same fashion attached to bow string run 42 near its opposite end 48.

As indicated by arrows 50 and 52 in FIG. 2, the just-described method of assembling bow string silencer 22 (and bow string silencer 24) to bow string run 42 leaves the two string silencer segments 54 and 56 on opposite sides of knot 44 free to oscillate,bend, and otherwise flex relative to the knot, and vibrations may also be set up within each of the two string silencer segments 54 and 56 on opposite sides of knot 44. The result of this wiggling and jiggling is an altered pattern of bow string vibration and a marked decrease in the level of sound (or twang) generated when an arrow is released. At the same time, and in contrast to typical, heretofore available string silencers, the loss in arrow velocity attributable to the presence of the string silencers is minimal (typically, not more than two feet per second).

Figure 5:
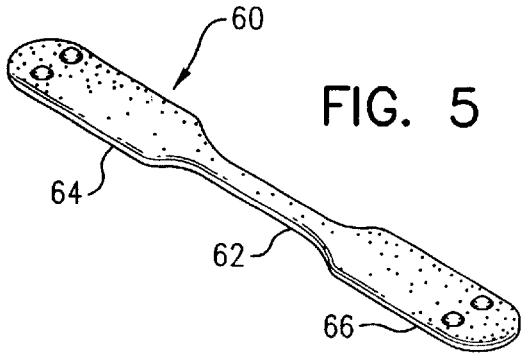
FIG. 5 is a perspective view of a second string silencer embodying the principles of the invention; this silencer differs from the FIG. 3 string silencer in that it has a necked down center section.

Referring still to the drawing, FIG. 5 depicts a second string silencer 60 also fabricated in accord with, and embodying, the principles of the present invention. This string silencer, also employed in pairs with one silencer at each end of the bow string run in which an arrow is nocked, differs from silencer 22 in that it has a necked down center segment 62 located between two integral end segments 64 and 66. This optional necked down section stretches and contracts to keep the string silencer in place when an arrow is released and the bow string vibrates. In most cases, however, this enhancement of the string gripping capability of the silencer is not necessary as the NAVCOM or comparable material provides adequate gripping ability due to its softness.

As just suggested, string silencer 60 may be fabricated from the same types of materials as string silencers 22 and 24; and it will typically have the same dimensions as those silencers.

Figure 6:
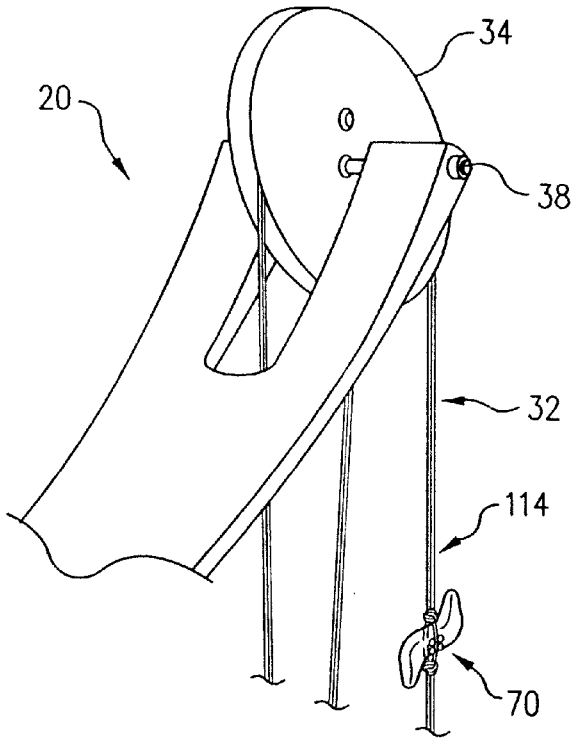
FIG. 6 is a fragmentary view of a compound bow equipped with a third type of flexible string silencer which embodies the principles of the present invention and is designed for use with a split bow string.
Figure 7:
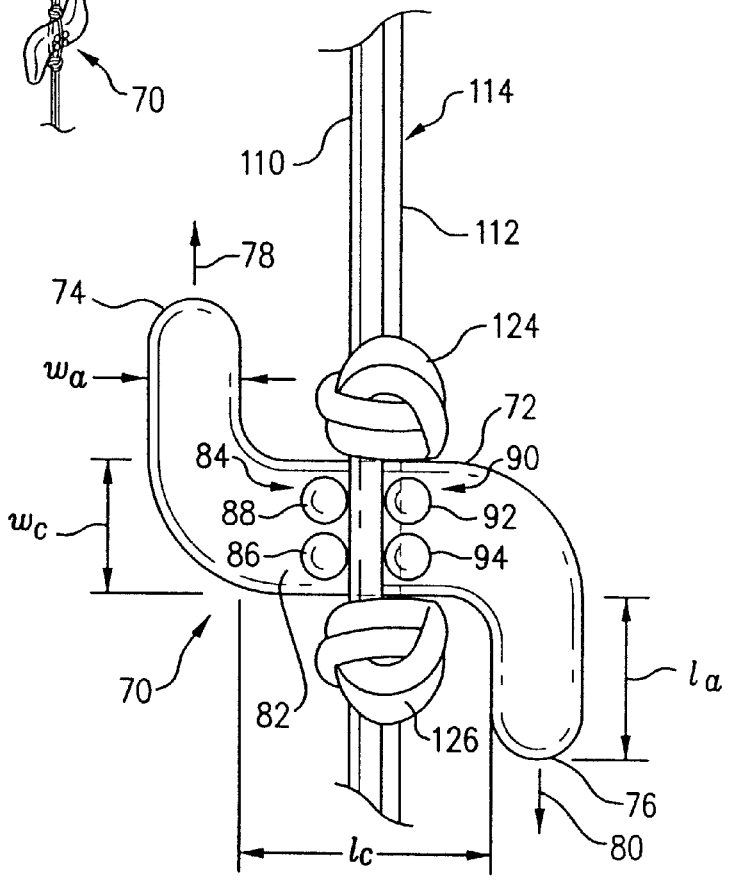
FIG. 7 is a right-hand side view of the split bow string and string silencer.
Figure 8:
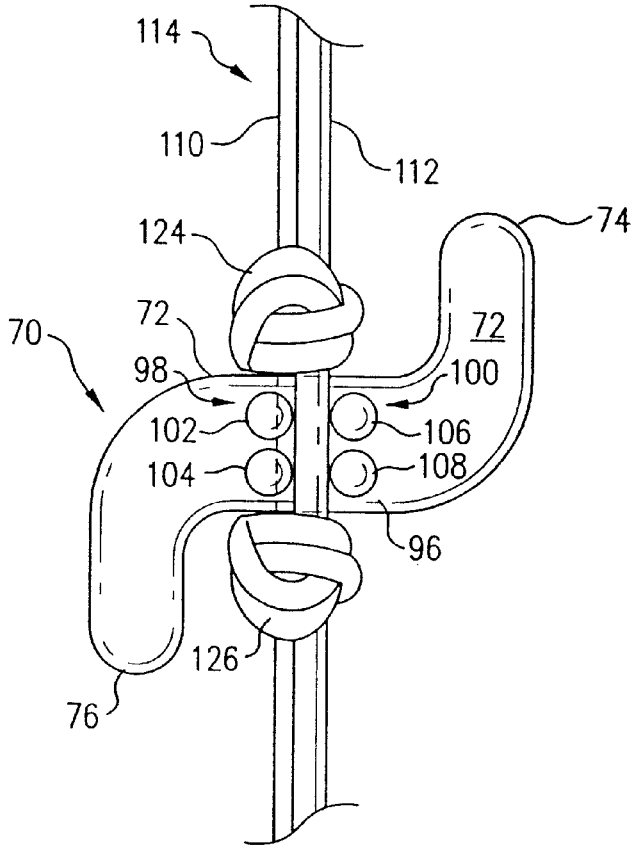
FIG. 8 is a left-hand side view of the bow string and silencer.

With continued reference to the drawing, FIG. 6 depicts, in fragmentary form, a compound bow equipped with string silencers (only one of which is shown) of the type shown in more detail in FIGS. 7–11. The string silencer is identified by reference character 70.

The FIG. 6 bow may duplicate the bow shown in FIG. 1. Accordingly, the same reference characters have been employed to identify the two bows and their components.

Silencer 70 has a center segment 72 and integral arms 74 and 76, one at each end of the central segment. These arms extend at right angles from central segment 72 and in opposite directions from that segment as indicated by arrows 78 and 80 in FIG. 7. From the side, the width $w_1$ of arms 74 and 76 is uniform (see FIGS. 7 and 8). End on, the arms have a wedge shape, being thicker at the ends integrated with center silencer segment 72 than at their outer ends as indicated by $t_1$ and $t_2$.

There are two complementary pairs of bosses or protrusions on each side of string silencer central segment 72. On that side 82 of string silencer 70 shown in FIG. 7, one pair of bosses is identified by reference character 84. This pair is composed of bosses 86 and 88.

The second, complementary pair of bosses on the same side 82 of string silencer 70 is identified by reference character 90 with reference characters 92 and 94 identifying the bosses per se.

The two pairs of bosses on the opposite side 96 of string silencer 70 (see FIG. 8) are identified by reference characters 98 and 100 with reference characters 102 and 104 identifying the two bosses in pair 98 and reference characters 106 and 108 identifying the two bosses in pair 100.

String silencer 70 (and its companion) may be fabricated from the same NAVCOM material as string silencers 22, 24, and 60. Representative dimensions (approximate) of a string silencer as shown in FIGS. 6–11 are:

Center Segment

| | |
|---|---|
| Length ($l_c$) | 0.44 in |
| Width ($w_c$) | 0.25 in |
| Thickness ($t_c$) | 0.19 in |

Arms

| | |
|---|---|
| Length ($l_a$) | 0.34 in |
| Width ($w_a$) | 0.22 in |
| Thickness (inner end, $t_1$) | 0.19 in |
| Thickness (outer end, $t_2$) | 0.13 in |

String silencer 70 (and its companion) are installed between the elements 110 and 112 of the split bow string run 114 shown in FIGS. 6, 7, 8, 10, and 11. Element 110 is trapped between the two pairs of bosses 84 and 90 on side 82 of string silencer 70. Split bow string element 112 is similarly trapped between the two pairs of bosses 98 and 100 on the opposite side 96 of the string silencer.

The just-described arrangement secures string silencer 70 in place on bow string run 114 while leaving the two arms 74 and 76 of the string silencer free to oscillate, bend, and otherwise move relative to the central segment 72 of the string silencer when an arrow is released. This is suggested by the three sets 116, 118 and 120 of dotted lines in FIG. 11. Vibrations can also be set up in the two arms 74 and 76 of the silencer and, to a lesser extent, in the central segment 72 of the silencer. The result of this wiggling and jiggling is a marked attenuation of the sound generated when an arrow is released.

Figure 10:
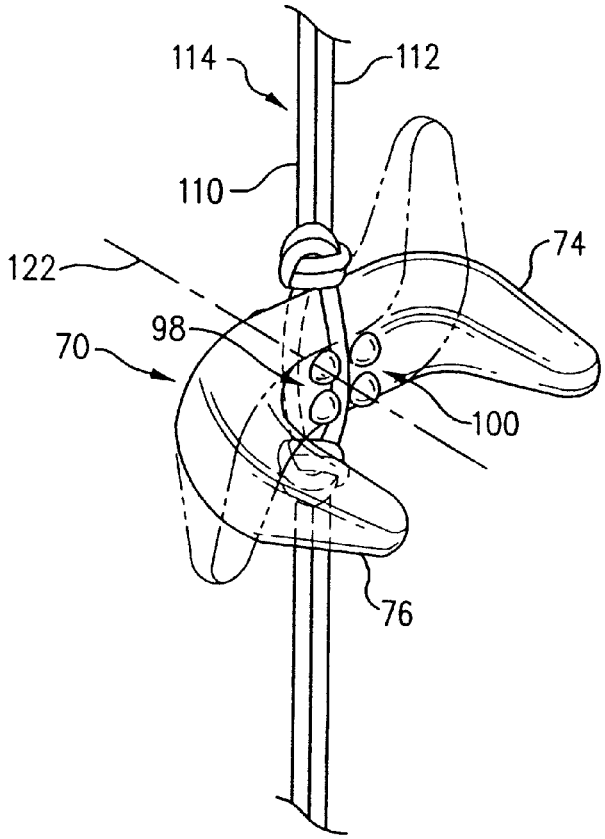
FIG. 10 shows the configuration assumed by the FIGS. 6–9 string silencer in that moment immediately following the release of an arrow; this configuration is effective in reducing the drift of an arrow when the arrow is released.
Figure 9:
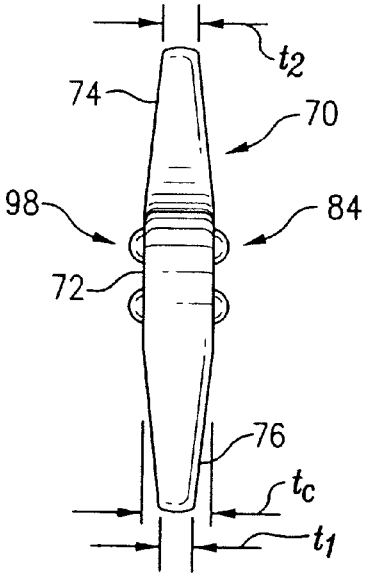
FIG. 9 is an end view of the string silencer.
Figure 11:
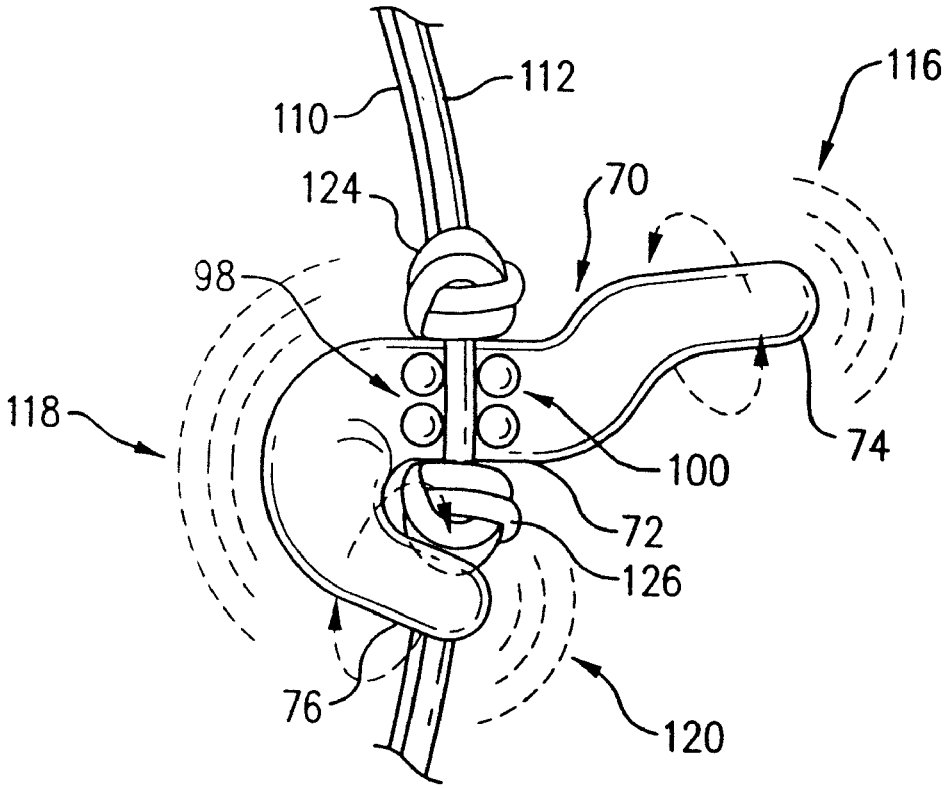
FIG. 11 is similar to FIG. 8 but shows how the string silencer might wiggle and jiggle to alter vibration patterns and reduce the sound generated when the bow string is released.

FIG. 10 shows, in solid lines, the relationship between the two arms 74 and 76 of string silencer 70 of the moment immediately following of arrow release. In particular, the two arms during that moment assume a parallel relationship with the arms: (a) at equal distances from the bow's (and bow strings) axis of symmetry 122, and (b) trailing center segment 72. This ensures that the weight of the silencer is equal on both sides of axis 20. As a consequence, the drift of an arrow that might occur if the weight of the silencer was unevenly distributed relative to axis 120 is avoided.

Gaps between the elements of a split bow string result in a loss of arrow velocity that is directly related to the width of the gap. In applications of the present invention such as that shown in FIGS. 6–8, 10, and 11 where the string silencer 70 (on a comparable silencer) is mounted between the two elements of a split bow string, this gap can be essentially eliminated by serving in the run of the bow string in which the silencer is installed. This is done by knotting the two elements 100 and 112 of the bow string run 114 together immediately above and below the silencer (the two knots are identified by reference characters 124 and 126).

Figure 12:
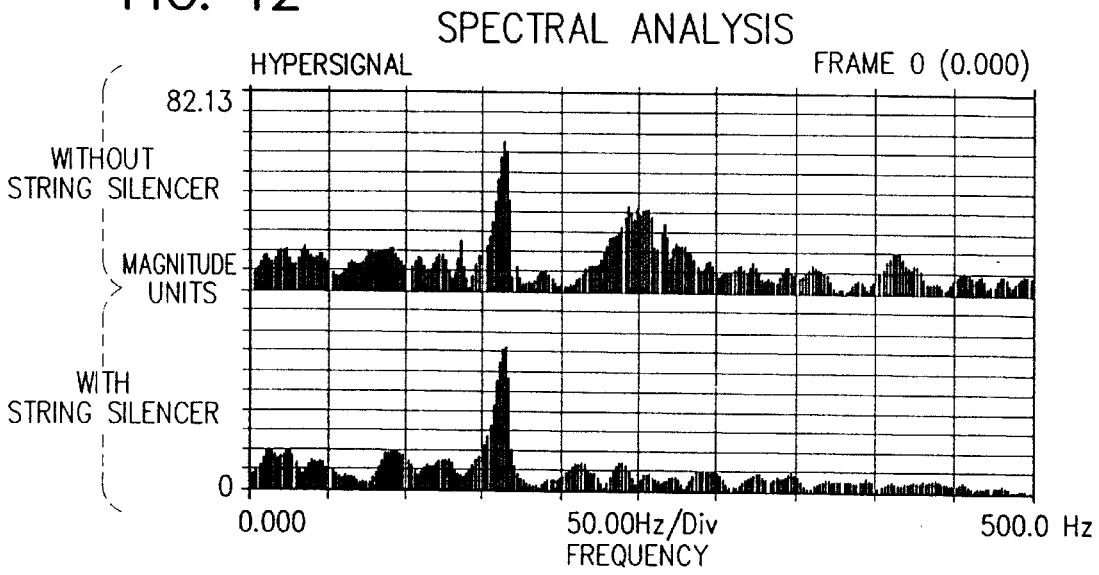
FIG. 12 is a graph showing the significant extent to which the magnitude of sounds in a wide range of frequencies are reduced by employing string silencers as illustrated in FIGS. 6–10.

FIG. 12 is a spectral analysis of the vibrations set up in the string of a compound bow when an arrow is released: (1) with no string silencers, and (2) with two string silencers as identified by reference character 70 attached to the split string run 114 of bow string 32. This figure shows that the string silencers significantly decrease sound producing bow string vibrations set up in the bow string when an arrow is released.

Figure 13:
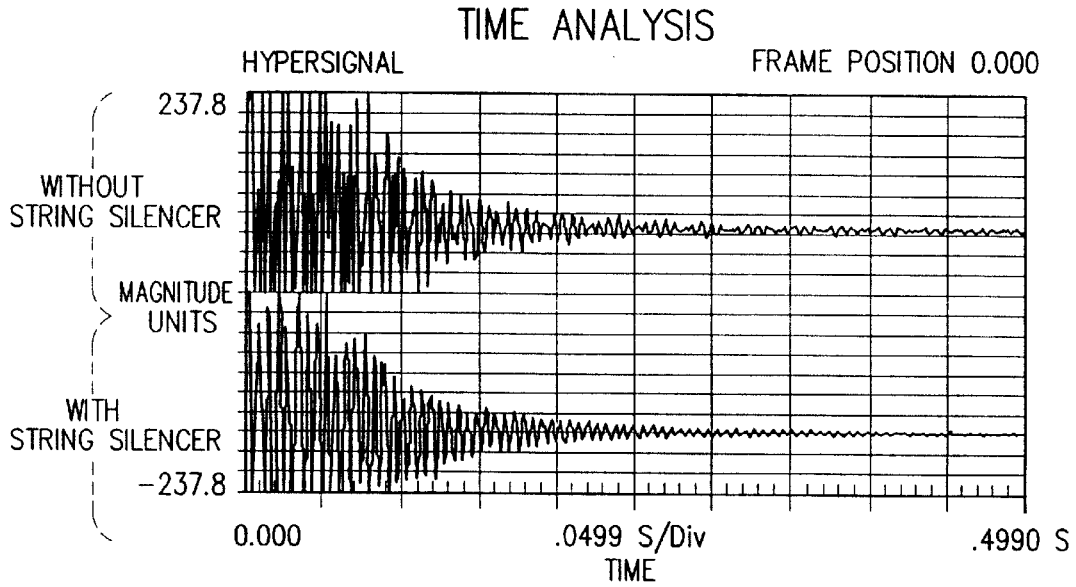
FIG. 13 is a graph showing how string silencers illustrated in FIGS. 6–10 significantly reduce the level of the sound (or twang) generated when an arrow is released from a bow equipped with such silencers.

Complementary FIG. 13 shows that there is a marked reduction of bow string vibrations (and, accordingly, sound), particularly in those first milliseconds after an arrow is released when the vibrations are the strongest and sound the loudest.

As will be apparent to the reader, the present invention may be embodied in many forms without departing from the spirit or essential characteristics of the invention. The present embodiments are therefore to be considered in all respects as illustrative and not restrictive. The scope of the invention is indicated by the appended claims rather than by the foregoing description and the drawings; and all changes which come within the meaning and range of equivalency of the claims are intended to be embraced therein.

What is claimed is:

1. The combination of:

a bow;

a bow string; and a silencer assembled to the bow string:

said silencer being a single elongated strip which is fabricated from an elastomeric material;

said silencer being so configured and related to the bow string that segments of the silencer can flex when an arrow is released and vibrations are consequentially set up in the bow string; and there being a single overhand knot which is: (a) tied in said silencer and around the entire circumference of the bow string, and (b) attaches the silencer to the bow string.

2. The combination of:

a bow;

a bow string; and a silencer assembled to the bow string;

said silencer being fabricated from an elastomeric material;

said silencer being so configured and related to the bow string that segments of the silencer can flex when an arrow is released and vibrations are consequentially set up in the bow string;

the bow string being split into elements;

the silencer being installed between the elements of the bow string;

said silencer having a center segment and first and second arms;

said arms being integrated with the center segment at opposite ends of said segment; and when said silencer is unstressed, said first and second arms extending in opposite directions from, and at equal angles to, said center segment.

3. The combination of:

a bow;

a bow string; and a silencer assembled to the bow string;

said silencer being fabricated from an elastomeric material;

said silencer being so configured and related to the bow string that segments of the silencer can flex when an arrow is released and vibrations are consequentially set up in the bow string;

the bow string being split into elements and the silencer being installed between the elements of the bow string; and there being complementary protrusions on opposite sides of the silencer for trapping the first and second bow string elements on opposite sides of the silencer and thereby securing the silencer between and to said elements.

4. The combination of:

a bow;

a bow string; and a silencer assembled to the bow string;

said silencer being fabricated from an elastomeric material;

said silencer being so configured and related to the bow string that segments of the silencer can flex when an arrow is released and vibrations are consequentially set up in the bow string;

the string silencer being an elongated component with a generally rectangular cross section; and the silencer having first and second end segments and a necked down center segment which is integrated, at opposite ends thereof, with said end segments.

5. The combination of:

a bow;

a bow string; and a silencer assembled to the bow string;

said silencer being fabricated from an elastomeric material which is a viscoelastic mixture of choroprene and butyl polymers;

said silencer being so configured and related to the bow string that segments of the silencer can flex when an arrow is released and vibrations are consequentially set up in the bow string.

6. A combination as defined in claim 5 in which the string silencer is an elongated component with a generally rectangular cross section.

7. A combination as defined in claim 6 in which the cross-section of the string silencer is essentially the same throughout the length of the silencer.

8. A bow string silencer;

said silencer being fabricated from an elastomeric material and being so configured that, when attached to a bow string, segments of the silencer can wiggle and jiggle when an arrow is released to reduce the sound emanating from the bow string upon the release of said arrow;

said silencer having a center segment and first and second arms;

said arms being integrated with the center segment at opposite ends of said segment; and when said silencer is unstressed, said first and second arms extending in opposite directions from, and at equal angles to, said center segment.

9. A bow string silencer;

said silencer being fabricated from an elastomeric material and being so configured that, when attached to a bow string, segments of the silencer can wiggle and jiggle when an arrow is released to reduce the sound emanating from the bow string upon the release of said arrow; and there being complementary protrusions on opposite sides of the silencer for trapping said silencer between first and second bow string elements and thereby securing the silencer between and to said elements.

10. A bow string silencer;

said silencer being fabricated from an elastomeric material and being so configured that, when attached to a bow string, segments of the silencer can wiggle and jiggle when an arrow is released to reduce the sound emanating from the bow string upon the release of said arrow;

said silencer being an elongated, slit and aperture free component with a cross-section which is essentially the same throughout the length of the silencer; and said silencer being so dimensioned and configured that it can be attached to a bow string by tying a single overhand knot in the silencer.

11. A bow string silencer;

said silencer being fabricated from an elastomeric material and being so configured that, when attached to a bow string, segments of the silencer can wiggle and jiggle when an arrow is released to reduce the sound emanating from the bow string upon the release of said arrow; and said silencer having first and second end segments and a necked down center segment which is integral, at opposite ends thereof, with said end segments.

12. A bow string silencer;

said silencer being fabricated from an elastomeric material and being so configured that, when attached to a bow string, segments of the silencer can wiggle and jiggle when an arrow is released to reduce the sound emanating from the bow string upon the release of said arrow;

said silencer having a center segment and first and second arms;

said arms being integrated with the center segment at opposite ends of said segment;

said first and second arms extending in opposite directions from said center segment; and said arms being so configured and related to said center segment that, in the moment after an arrow is released, said arms: (a) are parallel, (b) at equal distances from, and on opposite sides of, an axis of symmetry through the bow and bowstring, and (c) trail the center segment of the silencer.

* * * * *

US006237584C1

(12) EX PARTE REEXAMINATION CERTIFICATE (9215th)

United States Patent

Sims

(10) Number: US 6,237,584 C1

(45) Certificate Issued: Aug. 21, 2012

(54) ARCHERY BOWS

(75) Inventor: Steven C. Sims, Shelton, WA (US)

(73) Assignee: Sims Vibration Laboratory, Inc., Shelton, WA (US)

Reexamination Request:
No. 90/009,914, Jul. 18, 2011

Reexamination Certificate for:

| | |
|---|---|
| Patent No.: | **6,237,584** |
| Issued: | **May 29, 2001** |
| Appl. No.: | **09/466,512** |
| Filed: | **Dec. 17, 1999** |

(51) Int. Cl.

| | |
|---|---|
| ***F41B 5/14*** | (2006.01) |
| ***F41B 5/00*** | (2006.01) |

(52) U.S. Cl. ..... 124/92

(58) Field of Classification Search ..... None
See application file for complete search history.

(56) References Cited

To view the complete listing of prior art documents cited during the proceeding for Reexamination Control Number 90/009,914, please refer to the USPTO's public Patent Application Information Retrieval (PAIR) system under the Display References tab.

*Primary Examiner*—Peter C. English

(57) ABSTRACT

String silencers for reducing the sound made when an arrow is released from a bow. These silencers are made from a material which allows the silencer to freely flex when the arrow is released and the bow string begins to vibrate. Silencers usable with conventional bow strings and with split bow strings are disclosed. Disclosed silencers for conventional box strings have uniform and necked down configurations, and a representative, disclosed silencer for split bow strings has a center segment and integral arms at opposite ends of the center segment. With the silencer at rest, these arms extend in opposite directions from, and at equal angles to, the center segment.

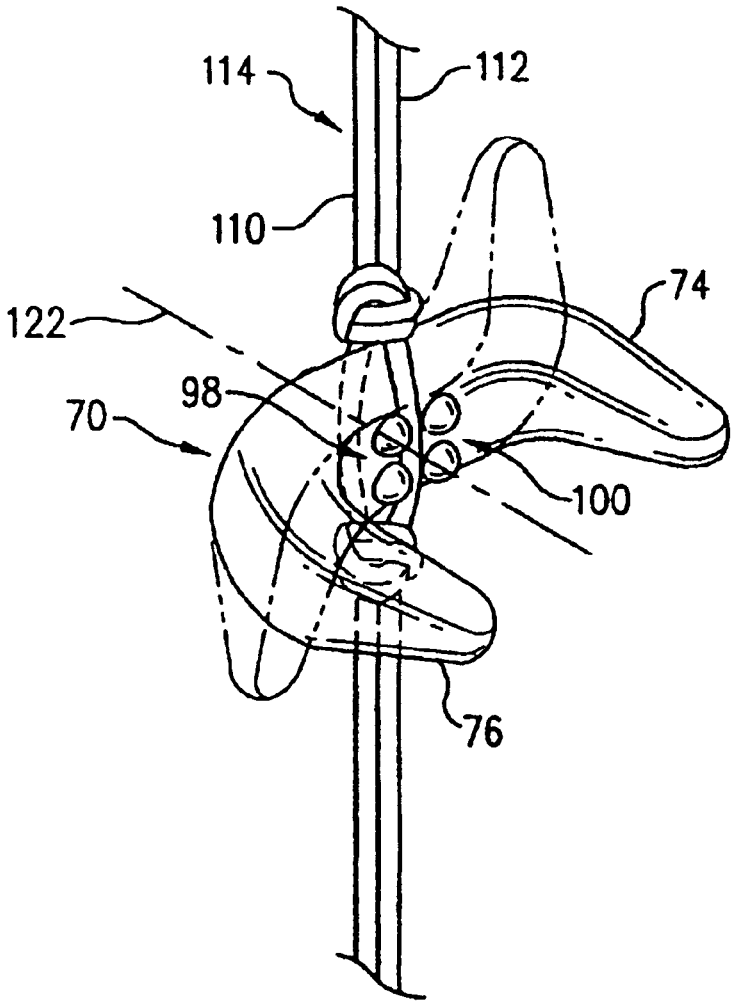

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 4 is confirmed.

Claims 1 and 10 are cancelled.

Claims 2, 3, 8 and 9 are determined to be patentable as amended.

New claims 13-18 are added and determined to be patentable.

Claims 5-7, 11 and 12 were not reexamined.

2. The combination of:

a bow;

a bow string; and a silencer assembled to the bow string;

said silencer being fabricated from an elastomeric material;

said silencer being so configured and related to the bow string that segments of the silencer can flex when an arrow is released and vibrations are consequentially set up in the bow string;

the bow string being split into elements;

the silencer being installed between the elements of the bow string;

said silencer having a center segment and first and second arms;

said arms being integrated with the center segment at opposite ends of said segment, *with said center segment being installed between the elements of the bow string*; and when said silencer is unstressed, said first and second arms extending in opposite directions from, and at equal angles to, *and being balanced around* said center segment*; and*

*when said silencer is stressed, said first and second arms being free to oscillate into approximately parallel positions without interference from other elements of said silencer.*

3. The combination of:

a bow;

a bow string; and a silencer assembled to the bow string;

said silencer being fabricated from an elastomeric material;

said silencer being so configured and related to the bow string that *first and second* segments of the silencer can flex when an arrow is released and vibrations are consequentially set up in the bow string;

the bow string being split into elements and *with a center segment of* the silencer being installed between the elements of the bow string; [and]

there being complimentary protrusions on opposite sides of the *center segment of the* silencer for trapping the first and second bow string elements on opposite sides of the silencer and thereby securing the silencer between and to said elements*; with the first and second silencer segments being balanced and centered around the center segment.*

8. A bow string silencer;

said silencer being fabricated from an elastomeric material and being so configured that, when attached to a bow string, segments of the silencer can wiggle and jiggle when an arrow is released to reduce the sound emanating from the bow string upon the release of said arrow;

said silencer having a center segment and first and second arms;

said *first and second* arms being integrated with*, and having portions extending from,* the center segment at opposite ends of said segment*, with the center segment being configured for installation between elements of the bow string*; and when said silencer is unstressed, said first and second arms extending in opposite directions from, and at equal angles to, *and being balanced and centered around* said center segment*; and further configured with clearance between the portions of the first and second arms extending from the center segment and all other elements such that when the silencer is stressed, the first and second arms are free to oscillate to positions approximately parallel to one another without interference from other elements of the silencer.*

9. A bow string silencer;

said silencer being fabricated from an elastomeric material and being so configured that, when *a center segment of the silencer is* attached to a bow string*, first and second* segments of the silencer *which are balanced and centered around the center segment* can wiggle and jiggle when an arrow is released to reduce the sound emanating from the bow string upon the release of said arrow; and there being complementary protrusions on opposite sides of the *center segment of the* silencer for trapping said silencer between first and second bow string elements and thereby securing the silencer between and to said elements.

*13. The combination of:*

*a bow;*

*a bow string; and*

*a silencer assembled to the bow string;*

*said silencer being fabricated from a viscoelastic elastomeric material;*

*said silencer being so configured and related to the bow string that segments of the silencer can flex viscoelastically when an arrow is released and vibrations are consequentially set up in the bow string;*

*the bow string being split into elements;*

*the silencer being installed between the elements of the bow string;*

*said silencer having a center segment and first and second arms;*

*said arms being integrated with the center segment at opposite ends of said segment, with said center segment being installed between the elements of the bow string; and*

*when said silencer is unstressed, said first and second arms extending in opposite directions from, and at equal angles to, and being balanced around said center segment; and*

*when said silencer is stressed, said first and second arms are free to oscillate into approximately parallel positions without interference from other elements of said silencer.*

*14. The combination of:*

*a bow;*

*a bow string; and*

*a silencer assembled to the bow string;*

*said silencer being fabricated from a viscoelastic elastomeric material;*

*said silencer being so configured and related to the bow string that first and second segments of the silencer can flex viscoelastically when an arrow is released and vibrations are consequentially set up in the bow string;*

*the bow string being split into elements and with a center segment of the silencer being installed between the elements of the bow string; and*

*there being complimentary protrusions on opposite sides of the center segment of the silencer for trapping the first and second bow string elements on opposite sides of the silencer and thereby securing the silencer between and to said elements; with the first and second silencer segments being balanced and centered around the center segment.*

*15. The combination of:*

*a bow;*

*a bow string; and*

*a silencer assembled to the bow;*

*said silencer being fabricated from a viscoelastic elastomeric material;*

*said silencer being so configured and related to the bow string that segments of the silencer can flex viscoelastically when an arrow is released and vibrations are consequentially set up in the bow string;*

*the string silencer being an elongated component with a generally rectangular cross section; and*

*the silencer having first and second end segments and a necked down center segment which is integrated, at opposite ends thereof, with said end segments.*

*16. A bow string silencer;*

*said silencer being fabricated from a viscoelastic elastomeric material and being so configured that, when attached to a bow string, segments of the silencer can viscoelastically wiggle and jiggle when an arrow is released to reduce the sound emanating from the bow string upon the release of said arrow;*

*said silencer having a center segment and first and second arms;*

*said first and second arms being integrated with, and having portions extending from, the center segment at opposite ends of said segment, with the center segment being configured for installation between elements of the bow string; and*

*when said silencer is unstressed, said first and second arms extending in opposite directions from, and at equal angles to, and being balanced and centered around said center segment; and further configured with clearance between the portions of the first and second arms extending from the center segment and all other elements such that when the silencer is stressed, said first and second arms are free to oscillate to positions approximately parallel to one another without interference from other elements of the silencer.*

*17. A bow string silencer;*

*said silencer being fabricated from a viscoelastic elastomeric material and being so configured that, when a center segment of the silencer is attached to a bow string, first and second segments of the silencer which are balanced and centered around the center segment can wiggle and jiggle when an arrow is released to reduce the sound emanating from the bow string upon the release of said arrow; and*

*there being complementary protrusions on opposite sides of the center segment of the silencer for trapping said silencer between first and second bow string elements and thereby securing the silencer between and to said elements.*

*18. A bow string silencer;*

*said silencer being fabricated from a viscoelastic elastomeric material and being so configured that, when a center segment of the silencer is attached to a bow string, first and second segments of the silencer which are balanced and centered around the center segment can viscoelastically wiggle and jiggle when an arrow is released to reduce the sound emanating from the bow string upon the release of said arrow;*

*said silencer having a center segment and first and second arms;*

*said arms being integrated with the center segment at opposite ends of said segment;*

*when said silencer is unstressed, said first and second arms extending in opposite directions from, and at equal angles to, said center segment; and*

*said arms being so configured and related to said center segment that said arms are free to move without interference from other elements of the silencer and such that, in the moment after an arrow is released, said arms: (a) are parallel, (b) at equal distances from, and on opposite sides of, an axis of symmetry through the bow and bowstring, and (c) trail the center segment of the silencer.*

* * * * *